US012503212B2

(12) United States Patent
Nio

(10) Patent No.: US 12,503,212 B2
(45) Date of Patent: Dec. 23, 2025

(54) PROPULSION APPARATUS FOR WATERCRAFT

(71) Applicant: HONDA MOTOR CO., LTD., Tokyo (JP)

(72) Inventor: Naotoshi Nio, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 161 days.

(21) Appl. No.: 18/476,543

(22) Filed: Sep. 28, 2023

(65) Prior Publication Data

US 2025/0108899 A1 Apr. 3, 2025

(51) Int. Cl.
*B63H 20/12* (2006.01)
*B63H 20/06* (2006.01)

(52) U.S. Cl.
CPC ..... *B63H 20/12* (2013.01); *B63H 20/06* (2013.01)

(58) Field of Classification Search
CPC ..... B63H 20/12; B63H 20/06
See application file for complete search history.

(56) References Cited

U.S. PATENT DOCUMENTS

| | | | | |
|---|---|---|---|---|
| 8,550,948 | B2 | 10/2013 | Pescheck et al. | |
| 2006/0052015 | A1* | 3/2006 | Otobe | F02D 31/009 440/87 |
| 2006/0110990 | A1* | 5/2006 | Yazaki | B63H 20/12 440/53 |
| 2022/0242540 | A1* | 8/2022 | Honda | B63H 23/30 |
| 2022/0348301 | A1* | 11/2022 | Arvidsson | B63H 25/24 |

* cited by examiner

*Primary Examiner* — Tisha D Lewis
(74) *Attorney, Agent, or Firm* — Armstrong Teasdale LLP

(57) ABSTRACT

A propulsion apparatus for watercraft, including a propulsion motor (M) supported by an upper case, a lower case (11) supported by the upper case so as to be rotatable around a steering axis, and rotatably supporting a drive shaft (22) for transmitting power from the propulsion motor to a propulsion device (13), a steering motor (30) received in the upper case, and a steering reduction gear mechanism (37) received in the upper case, wherein an axis of a rotational output of the steering reduction gear mechanism and an axis of a rotational output of the steering motor extend vertically in parallel with an axis of the drive shaft, and the steering motor overlaps with the steering reduction gear mechanism with respect to a vertical direction.

11 Claims, 6 Drawing Sheets

PROPULSION APPARATUS FOR WATERCRAFT

The present invention relates to a propulsion apparatus for watercraft and watercraft equipped with such a propulsion apparatus.

BACKGROUND ART

In recent years, active efforts have been made to provide access to sustainable transportation systems for vulnerable traffic participants such as senior citizens and children. As a part of such efforts, research efforts have been directed to the improvement of traffic safety and convenience through improvement in the operability of watercraft.

To improve the turning operability and turning response of watercraft including outboard boats and inboard boats, it is desirable to maximize the maximum steering angle of the propulsion apparatus of the watercraft. It is known that the steering angle can be maximized by using a propulsion apparatus that can change the direction of the propulsion unit thereof instead of relying on a rudder.

U.S. Pat. No. 8,550,948 discloses a propulsion apparatus for watercraft that includes an engine and a transmission fixed to the hull, and a propulsion unit fitted with a propeller and extending into the body of water. The power of the engine is transmitted to the propeller via the transmission, and the propulsion unit is configured to swivel around a vertical control axis. Thus, the steering of the watercraft can be achieved by swiveling the propulsion unit and changing the vector of the thrust provided by the propeller.

According to this prior art, the electric motor for providing the power for swiveling the propulsion unit, and a planetary gear mechanism interposed between the output shaft of the electric motor and the propulsion unit are positioned on top of each other so that the overall height of the steering system is undesirably great.

In view of such a problem of the prior art, a primary object of the present invention is to provide a propulsion apparatus for watercraft which is configured to swivel a propulsion unit around a vertical axis and compact in size, particularly in the vertical dimension thereof, and watercraft equipped with such a propulsion apparatus.

To solve such a problem, a certain aspect of the present invention provides a propulsion apparatus for watercraft, comprising: an upper case (10) supported by a hull of the watercraft; a propulsion motor (M) supported by the upper case; a lower case (11) supported by the upper case so as to be rotatable around a steering axis, and rotatably supporting a drive shaft (22) for transmitting power from the propulsion motor; a propulsion device (13) supported by the lower case so as to be rotationally driven by the drive shaft; a steering motor (30) received in the upper case; and a steering reduction gear mechanism (37) received in the upper case and configured to reduce a rotational speed of an output of the steering motor and rotationally drive the lower case, wherein an axis of a rotational output of the steering reduction gear mechanism and an axis of a rotational output of the steering motor extend vertically in parallel with an axis of the drive shaft, and the steering motor overlaps with the steering reduction gear mechanism with respect to a vertical direction.

Since the steering motor overlaps and the steering reduction gear mechanism overlap with each other along the vertical direction, the overall height of the upper case or the propulsion apparatus can be minimized.

In this propulsion apparatus for watercraft, preferably, the lower case is provided with a tubular upper end part (24) which is received in the upper case and rotatably supported by the upper case.

Since the lower case or the tubular upper end part thereof extends into the upper case, the lower case can be supported by the upper case in a stable manner, and the tubular upper end part that extends into the upper case can be used for transmitting the power output of the steering motor to the lower case.

In this propulsion apparatus for watercraft, preferably, the steering reduction gear mechanism has an input end (38) in a lower part thereof, and an output end (40) in an upper part thereof.

Since the output end or the low speed end is located in an upper part of the steering reduction gear mechanism, and the input end or the high speed end thereof is located in a lower part thereof so as to be dipped into an oil reservoir, the lubrication of the steering reduction gear mechanism can be performed in an efficient manner. In particular, by using a planetary gear mechanism for the steering gear mechanism, a large speed reduction can be achieved by using a highly compact structure.

In this propulsion apparatus for watercraft, preferably, the propulsion apparatus further comprises a brake mechanism (34) including a vertically extending brake shaft (33) and an electromagnetic clutch which selectively engages the brake shaft with a fixed part of the upper case, wherein the brake shaft is positioned in a power transmission path between the output of the steering motor and an input of the steering reduction gear mechanism.

The brake mechanism allows the lower case along with the propulsion device to be kept stationary, for instance, in case of a failure in the propulsion apparatus so that the reliability of the propulsion apparatus can be improved.

In this propulsion apparatus for watercraft, preferably, the brake shaft overlaps with the steering motor and the steering reduction gear mechanism with respect to the vertical direction.

Since the brake shaft overlaps with the steering motor and the steering reduction gear mechanism along the vertical direction, the overall height of the upper case or the propulsion apparatus can be minimized.

In this propulsion apparatus for watercraft, preferably, the output of the steering motor is provided by an output shaft (31) extending downward from the steering motor, and the input of the steering reduction gear mechanism is provided with an input shaft (38) extending downward from the steering reduction gear mechanism, the output shaft of the steering motor and the input shaft of the steering reduction gear mechanism being fixedly provided with respective spur gears (32, 36) which mesh with a spur gear (35) fitted on the brake shaft.

Thereby, the path of power transmission from the steering motor to the steering reduction gear mechanism can be simplified.

In this propulsion apparatus for watercraft, preferably, the spur gears provided on the output shaft of the steering motor, the input shaft of the steering reduction gear mechanism and the brake shaft have a substantially identical diameter.

Thereby, the path of power transmission from the steering motor to the steering reduction gear mechanism can be particularly simplified. Furthermore, a common spur gear can be used for these three spur gears so that the management of component parts can be simplified.

In this propulsion apparatus for watercraft, preferably, a lower part of the upper case is provided with an oil pan containing lubricating oil so that the lubricating oil is splashed by the spur gears.

Since the spur gears are positioned in a lower part of the upper case, lubricating oil which may be contained in the lower part of the upper case can be stirred so that the steering reduction gear mechanism can be lubricated in a favorable manner.

In this propulsion apparatus for watercraft, preferably, the brake mechanism includes an electromagnet (48) fixed to the upper case, a fixed plate (49) provided on top of the movable plate so as to define a certain gap thereto and fixed to the upper case, a movable plate (50) positioned in the gap so as to be movable in an axial direction, a rotatable plate (52) positioned between the movable plate and the fixed plate and fitted on the brake shaft in a rotationally fast manner, and a spring member (51) urging the movable plate against the rotatable plate so as to interpose the rotatable plate between the movable plate and the fixed plate, the electromagnet being configured to attract the movable plate away from the rotatable plate against a biasing force of the spring member when energized.

Thereby, in case of a failure in the steering system, the electromagnet may be deenergized so that the angular position of the lower case can be positively fixed, and an unpredictable behavior of the steering system at the time of a failure can be avoided.

In this propulsion apparatus for watercraft, preferably, the upper case is provided with an elliptic profile which is elongated in a fore and aft direction, and wherein the brake mechanism and a propulsion reduction gear mechanism are positioned on a longitudinal center line that extends in the fore and aft direction with the propulsion reduction gear mechanism ahead of the brake mechanism, and the steering reduction gear mechanism and the steering motor are positioned on either side of the longitudinal center line, between the propulsion reduction gear mechanism and the brake mechanism 34 with respect to the fore and aft direction.

Thereby, the major components of the propulsion apparatus can be placed in a limited space of the upper case in a highly compact manner, and the path of power transmission can be arranged in an efficient manner.

To solve the foregoing problem, another aspect of the present invention provides watercraft fitted with the propulsion apparatus defined above.

The present invention thus provides a propulsion apparatus for watercraft which is configured to swivel a propulsion device around a vertical axis and compact in size, particularly in the vertical dimension thereof, and watercraft equipped with such a propulsion apparatus.

DESCRIPTION OF THE PREFERRED EMBODIMENT(S)

A propulsion apparatus for watercraft in the form of an outboard motor 2 according to an embodiment of the present invention will be described in the following with reference to the appended drawings.

Figure 1:
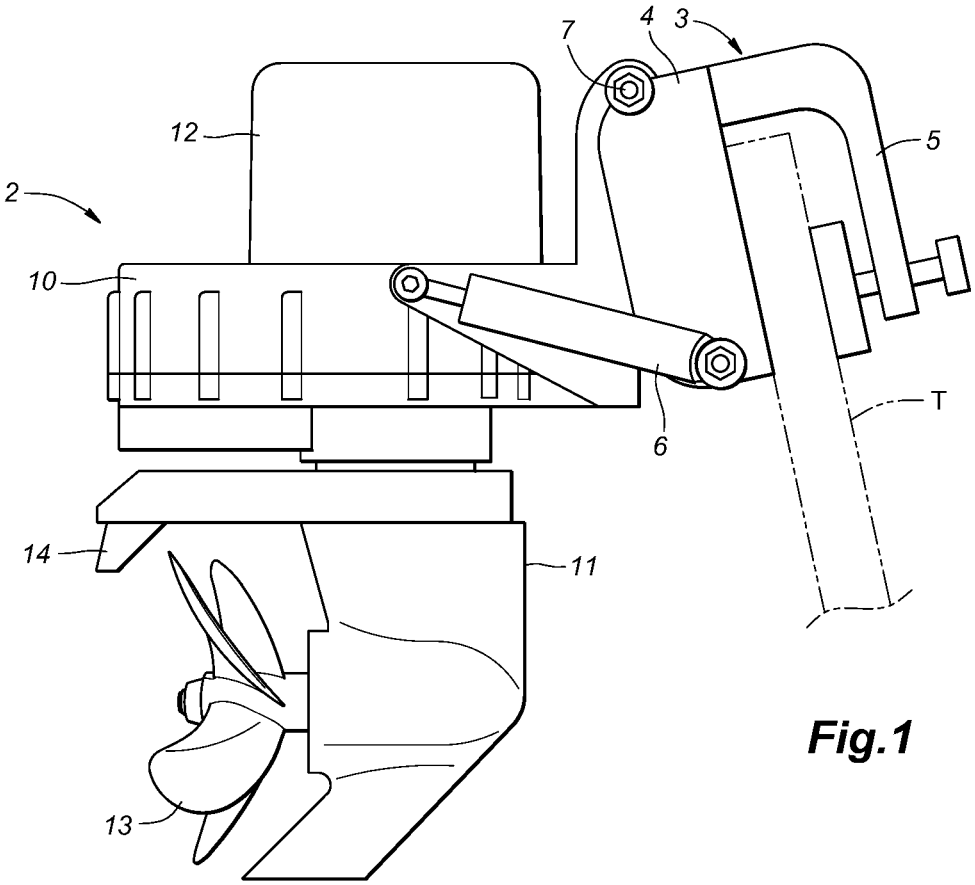
FIG. 1 is a side view of a propulsion apparatus according to the present invention attached to a stern of watercraft consisting of a boat.
Figure 2:
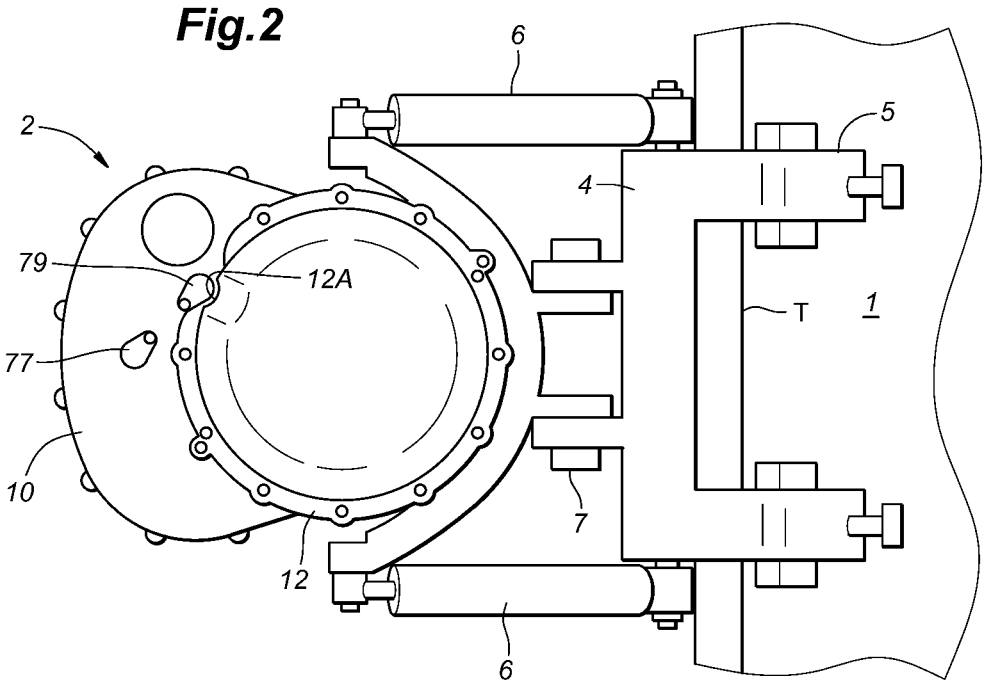
FIG. 2 is a top view of the propulsion apparatus.

As shown in FIGS. 1 and 2, an outboard motor 2 is mounted on a rear end of a boat 1 via a mounting device 3 that includes a bracket 4 that supports the outboard motor 2 and a clamp device 5 that detachably secure the bracket 4 to a transom T of the boat 1. The outboard motor 2 is supported by the bracket 4 via a laterally extending tilt shaft 7, and can be selectively tilted upward by an actuator 6 which may be pneumatically or electrically operated. In this conjunction, the following disclosure will be based on the assumption that the outboard motor 2 is in the tilted-down state or in the state for normal operation.

The outboard motor 2 is provided with an upper case 10 directly supported by the bracket 4, a motor case 12 attached to an upper end of the upper case 10, and a lower case 11 which extends downward from a lower end of the upper case 10 and is submerged in the water in a lower end part thereof during normal operation of the outboard motor 2. The upper case 10 has a circular or elliptic shape and is slightly elongated in the fore and aft direction in top view. The upper case 10 includes an upper half 10A and a lower half 10B which are joined at a substantially horizontal plane. The upper half 10A and a lower half 10B may each consist of a single piece member, or may each consist of a cylindrical main body and an upper or lower lid attached to the upper or lower end of the cylindrical main body, respectively. The upper case 10, motor case 12 and lower case 11 are made of stiff and durable material such as plastic and metallic materials.

Figure 4:
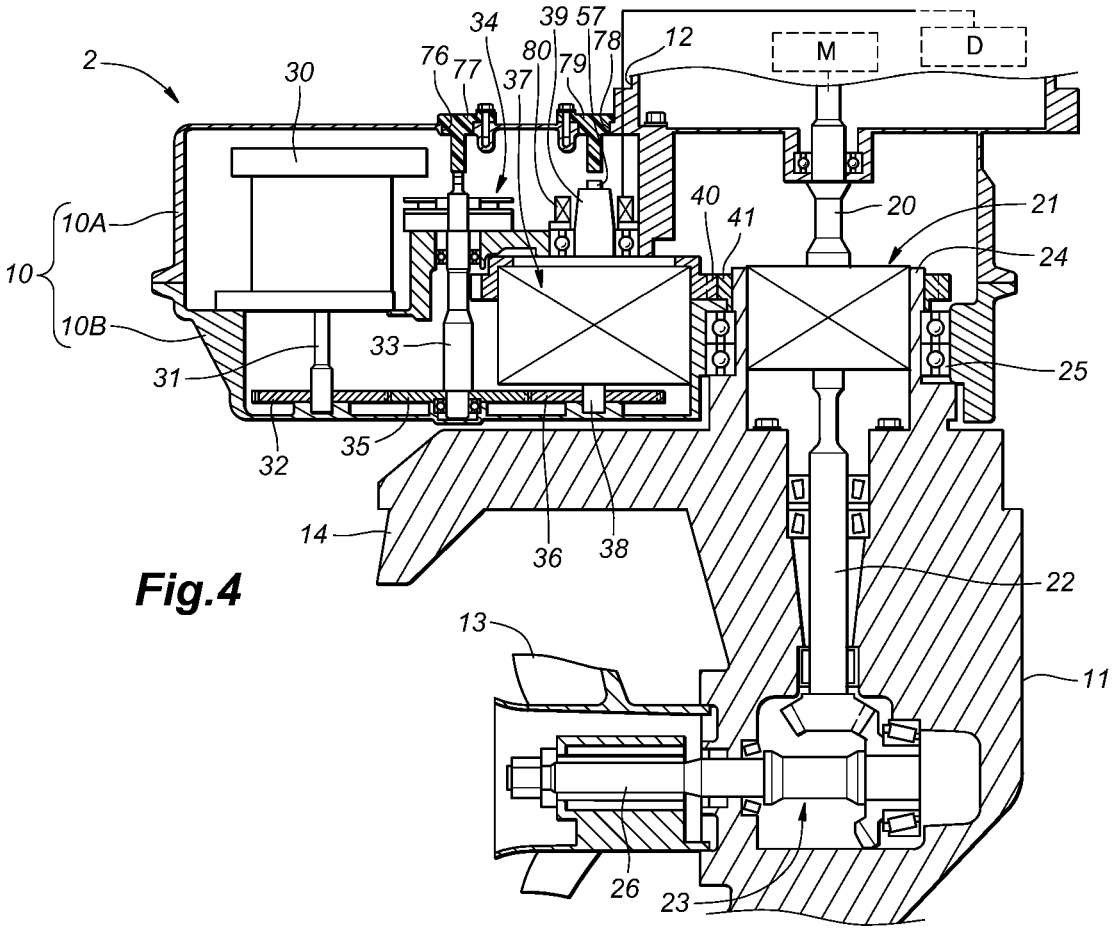
FIG. 4 is a vertical sectional view of the propulsion apparatus.

As shown in FIG. 4, the lower case 11 is provided with a tubular upper end part 24 which is rotatably supported by the upper case 10 via a ball bearing 25 so as to be rotatable around a vertical steering axis. The lower rear end part of the lower case 11 rotatably supports a propeller shaft 26 which is fitted with a propeller 13. An anti-ventilation plate 14 extends rearward from an upper part of the lower case 11 above the propeller 13.

Figure 3:
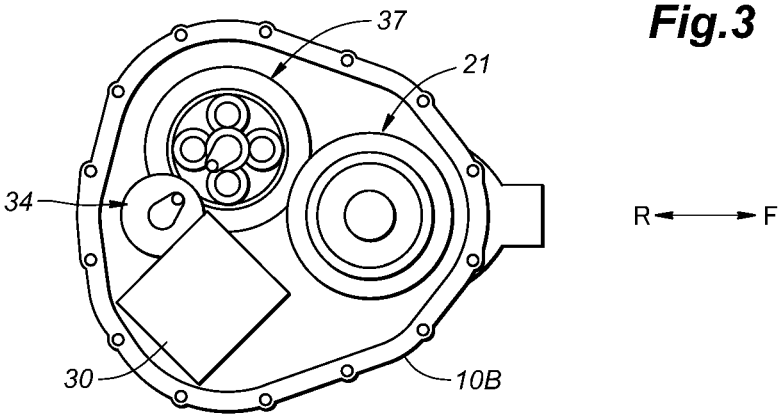
FIG. 3 is a simplified top view of a main part of the propulsion apparatus with an upper half of an upper cover removed.

As shown in FIGS. 3 and 4, a propulsion motor M consisting of an electric motor is received in the motor case 12, and is provided with an upper drive shaft 20 extending downward into the upper case 10. The lower end of the upper drive shaft 20 is connected to an input end of a propulsion reduction gear mechanism 21 which is received in a front end part of the upper case 10. An output end of the propulsion reduction gear mechanism 21 is connected to a lower drive shaft 22 which is coaxial with the upper drive shaft 20. The lower end of the lower drive shaft 22 is rotatably supported by the lower case 11, and is connected to an input end of a bevel gear mechanism 23 which is located in a lower end part of the lower case 11 and is configured to transmit the drive power from the lower drive shaft 22 to the propeller shaft 26.

To clearly illustrate the various components of the steering system of this outboard motor 2, FIG. 4 is given as a sectional view taken along a line extending along a path of power transmission.

A right side part of a rear end part of the upper case 10 receives a steering motor 30 consisting of an electric motor having an output shaft 31 extending downward therefrom. The lower end of the output shaft 31 which extends to a bottom end part of the upper case 10 is fitted with a first spur gear 32 in a rotationally fast manner.

A rear end part of the upper case 10 receives a brake mechanism 34 that includes a vertically extending brake shaft 33 and a second spur gear 35 fitted to the lower end of the brake shaft 33 in a rotationally fast manner. The second spur gear 35 meshes with the first spur gear 32.

Figure 6A:
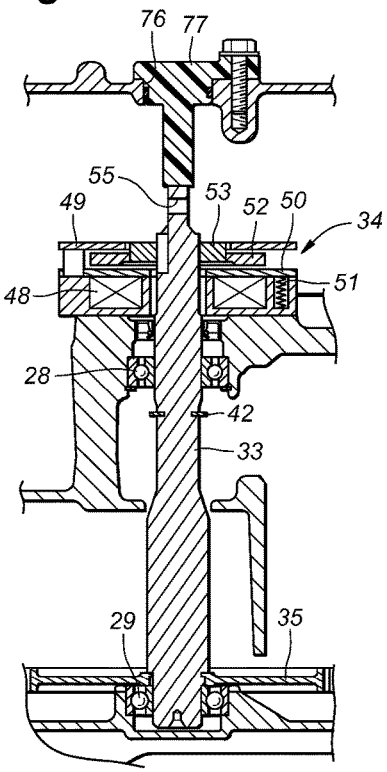
FIG. 6A is a fragmentary sectional view of the brake mechanism for the steering system of the propulsion apparatus in the engaged state.
Figure 6B:
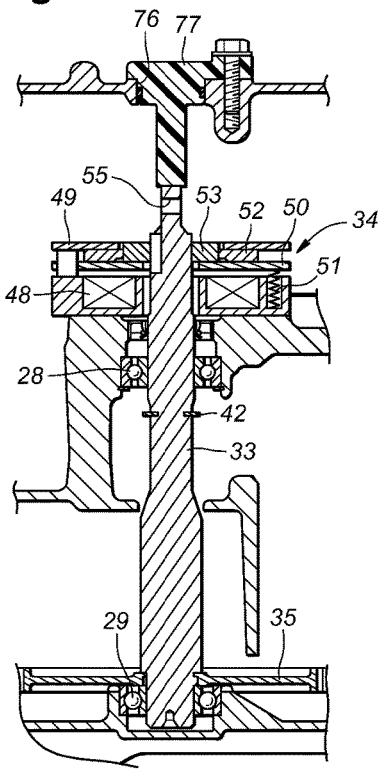
FIG. 6B is a view similar to FIG. 6A showing the brake mechanism in the disengaged state.
Figure 6C:
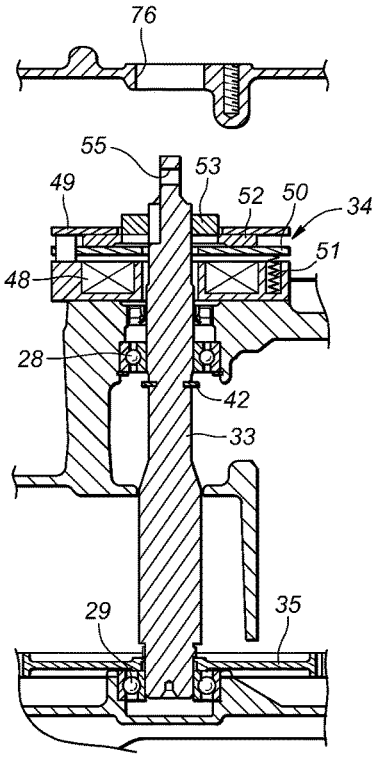
FIG. 6C is a view similar to FIG. 6A showing the brake mechanism in the engaged but manually disabled state.

FIG. 6A shows the brake mechanism 34 in greater detail. An annular electromagnet 48 is fixedly attached to a part of the upper case 10, and an annular fixed plate 49 is placed on top of the annular electromagnet 48 with a certain space defined between the annular electromagnet 48 and the annular fixed plate 49. An annular movable plate 50 is positioned in the space defined between the annular electromagnet 48 and the annular fixed plate 49.

An annular rotatable plate 52 is interposed between the annular fixed plate 49 and the annular movable plate 50. The central opening of the annular rotatable plate 52 is provided with a spline, and this spline meshes with a corresponding spline formed on an outer periphery of a hub member 53 fixedly fitted on the brake shaft 33 so that the annular rotatable plate 52 is rotationally fast with the brake shaft 33 and axially movable relative to the brake shaft 33.

An upper end part of the brake shaft 33 is passed through the central openings of the annular electromagnet 48, the annular rotatable plate 52 and the annular fixed plate 49. A plurality of coil springs 51 are interposed between the annular movable plate 50 and the annular electromagnet 48 so that the annular movable plate 50 is pressed against the annular rotatable plate 52. As a result, the annular rotatable plate 52 is normally interposed between the annular movable plate 50 and the annular fixed plate 49, and the brake shaft 33 is kept rotationally immobile.

The lower end of the brake shaft 33 is passed through the central opening of the second spur gear 35 in a rotationally fast and axially slidable manner, and is rotatably supported by the upper case 10. More specifically, a part of the brake shaft 33 immediately below the annular electromagnet 48 is supported by the upper case 10 via an upper roller bearing 28, and a lowermost part of the brake shaft 33 via a lower ball bearing 29. The lower ball bearings 29 are fixedly attached to the upper case 10 via the outer races thereof, but the brake shaft 33 is movable in the axially upward direction with respect to the second spur gear 35 and ball bearings 28 and 29 which are axially immovable. The limit of the axially upward movement of the brake shaft 33 is delimited by the abutting of a C-ring 42 fitted on an intermediate part of the brake shaft 33 against the ball bearing 28 from below.

Figure 5:
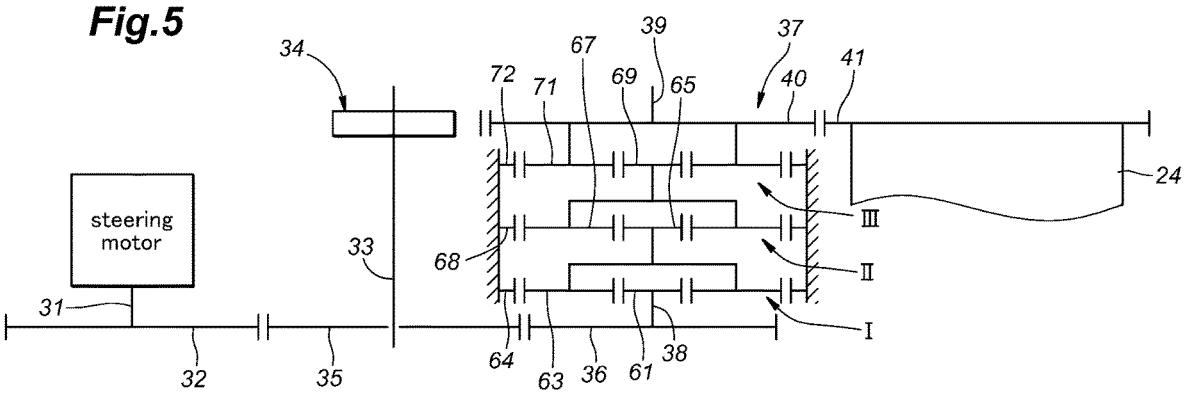
FIG. 5 is a skeleton diagram of the steering gear mechanism used in the steering system of the propulsion apparatus.

As shown in FIGS. 3 and 5, a left side part of a rear end part of the upper case 10 receives a steering reduction gear mechanism 37 consisting of a planetary gear mechanism that has an input shaft 38 extending downward therefrom and fitted with a third spur gear 36 that meshes with the second spur gear 35. An output shaft 39 extends upward from the upper end of the steering reduction gear mechanism 37, and is integrally connected to an output gear 40 having teeth arranged along the outer periphery of an upper part of the steering reduction gear mechanism 37.

Thus, the upper case 10 is provided with a circular or elliptic profile which is elongated in a fore and aft direction, and the brake mechanism 34 and the propulsion reduction gear mechanism 21 are positioned on a longitudinal center line that extends in the fore and aft direction with the propulsion reduction gear mechanism 21 ahead of the brake mechanism 34. Further, the steering reduction gear mechanism 37 and the steering motor 30 are positioned on either side of the longitudinal center line, between the propulsion reduction gear mechanism 21 and the brake mechanism 34 with respect to the fore and aft direction.

FIG. 5 illustrates the gear structure of the steering reduction gear mechanism 37 which includes three planetary gear units I to III positioned on top of another. The planetary gear unit I includes a sun gear 61 connected to the input shaft 38, carrier gears 63 jointly supported by a carrier and meshing with the sun gear 61, and a ring gear 64 fixed to the housing of the steering reduction gear mechanism 37 and meshing with the carrier gears 63. The planetary gear unit II includes a sun gear 65 directly connected to the carrier supporting the carrier gears 63 of the planetary gear unit I, carrier gears 67 jointly supported by a carrier and meshing with the sun gear 65, and a ring gear 68 fixed to the housing of the steering reduction gear mechanism 37 and meshing with the carrier gears 67. The planetary gear unit III includes a sun gear 69 directly connected to the carrier supporting the carrier gears 67 of the planetary gear unit II, carrier gears 71 jointly supported by a carrier and meshing with the sun gear 69, and a ring gear 72 fixed to the housing of the steering reduction gear mechanism 37 and meshing with the carrier gears 71. The carrier of the planetary gear unit III is directly connected to the output gear 40 of the steering reduction gear mechanism 37.

The tubular upper end part 24 of the lower case 11 is provided with a ring gear 41 along an outer periphery thereof, and this ring gear 41 meshes with the output gear 40 of the steering reduction gear mechanism 37.

As shown in FIG. 3, the outboard motor 2 is generally provided with an elliptic profile which is elongated in the fore and aft direction for the convenience of the positioning of the outboard motor 2 and for aesthetic considerations. In the present embodiment, the brake mechanism 34 is positioned behind the propulsion reduction gear mechanism 21 on the longitudinal center line, and the steering reduction gear mechanism 37 and the steering motor 30 are positioned on either side of the longitudinal center line, between the propulsion reduction gear mechanism 21 and the brake mechanism 34 with respect to the longitudinal direction (fore and aft direction). Thereby, the propulsion reduction gear mechanism 21, the steering motor 30, the brake mechanism 34 and the steering reduction gear mechanism 37 can be accommodated in the upper case 10 in a highly compact manner. As shown in FIG. 4, the steering motor 30 overlaps with the steering reduction gear mechanism 37 with respect to the vertical direction so that the overall height of the upper case 10 and the steering system can be minimized. Also, the brake shaft overlaps with the steering motor and the steering reduction gear mechanism with respect to the vertical direction, thereby the overall height of the upper case 10 or the propulsion apparatus can be minimized.

The spur gears 32, 35, 36 provided on the output shaft 31 of the steering motor 30, the input shaft 38 of the steering reduction gear mechanism 37 and the brake shaft 33 have a substantially identical diameter. Thereby, the path of power transmission from the steering motor 30 to the steering reduction gear mechanism 37 can be particularly simplified. Furthermore, a common spur gear can be used for these three spur gears 32, 35, 36 so that the management of component parts can be simplified.

The mode of operation of the propelling system of this outboard motor 2 will be discussed in the following with reference to FIG. 4.

The upper drive shaft 20 extending downward from the propulsion motor M is connected to the lower drive shaft 22 via a propulsion reduction gear mechanism 21 which may consist of a single-stage planetary gear system. The propulsion reduction gear mechanism 21 may consist of other per se known reduction gear mechanisms. Thus, the rotational output of the propulsion motor M is transmitted to the bevel gear mechanism 23, and thence to the propeller shaft 26 that supports the propeller 13. Since the power source is an electric motor, when the boat is desired to be propelled rearward, the rotational direction of the propulsion motor M is reversed.

The mode of operation of the steering system of this outboard motor 2 will be discussed in the following with reference to FIG. 4.

The rotational output of the steering motor 30 is transmitted from the output shaft 31 thereof to the brake shaft 33 via the first spur gear 32 and the second spur gear 35. During normal operation of the outboard motor 2, the annular electromagnet 48 is energized. Therefore, as shown in FIG. 6A, the annular movable plate 50 is pulled away from the annular rotatable plate 52 under the magnetic attractive force of the annular electromagnet 48 against the biasing force of the compression coil springs 51. Therefore, the annular rotatable plate 52 and brake shaft 33 are freely rotatable.

When the outboard motor 2 is not in operation and the steering system is not activated, the annular movable plate 50 is pushed against the annular rotatable plate 52 under the biasing for the compression coil springs 51, causing the annular rotatable plate 52 to be clamped between the annular movable plate 50 and the annular fixed plate 49. As a result, the annular rotatable plate 52 and the brake shaft 33 are prevented from turning. Thereby, the outboard motor 2 is prevented from being steered in an unpredictable manner when not in operation.

Thus, the rotational output of the steering motor 30 is further transmitted from the brake shaft 33 to the input shaft 38 of the steering reduction gear mechanism 37 via the second spur gear 35 and the third spur gear 36. The steering reduction gear mechanism 37 includes three planetary gear units I to III connected in tandem so that a significant speed reduction can be attained at the output shaft 39 thereof in spite of the compact size of the steering reduction gear mechanism 37. The output gear 40 which is integrally joined to the output shaft 39 meshes with the ring gear 41 of the tubular upper end part 24 of the lower case 11.

Thus, by activating the steering motor 30, the lower case 11 along with the propeller 13 can be turned in any desired direction. Owing to the high gear ratio of the steering reduction gear mechanism 37, the steering motor 30 is not required to produce a large output torque.

The bottom part of the upper case 10 serves as an oil pan for the lubricating oil that lubricates the spur gears 32, 35, 36 and the steering reduction gear mechanism 37. Since the spur gears 32, 35, 36 are positioned in a lower part of the upper case 10, lubricating oil which may be contained in the lower part of the upper case 10 can be stirred so that the steering reduction gear mechanism 37 can be lubricated in a favorable manner.

In a power steering system, it is desirable that the steering action can be performed manually in case the output of the steering motor 30 is not available due to a faulty component part or a lack of electric charge in the battery for powering the steering motor. An arrangement for manually steering this outboard motor 2 will be described in the following with reference to FIG. 4.

The upper wall of the upper case 10 is provided with a pair of openings 76 and 78 at positions corresponding to the brake shaft 33 and the output shaft 39 of the steering reduction gear mechanism 37, respectively. These openings 76 and 78 are normally closed by plugs 77 and 79, respectively, which are normally secured to the upper case 10 by screws. These plugs 77 and 79 may have an identical configuration for the convenience of the management of component parts.

When the outboard motor 2 is desired to be steered manually, these plugs 78 and 79 are removed. The upper end of the brake shaft 33 is formed with an engagement portion 55 (which may consist of a hole passed laterally therethrough or any other shape engagement feature). A tool including a rod having an engagement portion (which may consist of a rod having a hooked end or any other shape engagement feature) configured to cooperate with engagement portion 55 of the brake shaft 33 and a handle provided on the opposite end of the rod is prepared. The engagement portion of the tool is engaged with the engagement portion 55 of the brake shaft 33, and is pulled upward along with the brake shaft 33 until the C-ring 42 abuts against the ball bearing 28. As a result, the spline on the hub member 53 fitted on the brake shaft 33 is lifted, and disengaged from the annular rotatable plate 52, and the brake shaft 33 is thereby made freely rotatable.

The plug 77 is provided with a downwardly extending projection at the lower end thereof which abuts against or is positioned close to the upper end of the brake shaft 33 during normal operation of the outboard motor 2. Therefore, when the annular electromagnet 48 is deenergized for any reason when the outboard motor 2 is not operating, the brake shaft 33 is prevented from being inadvertently shifted upward and becoming freely rotatable.

Then, another tool which may include a rod, a box spanner (or any other shape engagement feature) formed at a free end thereof and a handle provided at the base end of the rod is inserted into the hole 78. The upper end of the output shaft 39 is provided with a hexagonal head 57 (or any other corresponding shape engagement feature). The box spanner is fitted onto the hexagonal head 57, and is turned in a desired direction via the handle. As a result, the output shaft 39 along with the lower case 11 is turned in the desired direction via the output gear 40 and the ring gear 41. At this time, since the brake mechanism 34 is disabled or released, the brake force is prevented from being amplified by the steering reduction gear mechanism 37 to such an extent as to make manual steering unacceptably difficult.

The opening 78 and the hexagonal head 57 are positioned so close to the propulsion motor M and the motor case 12, these parts may prevent an easy access to the opening 78 and the hexagonal head 57. To alleviate this problem, the motor case 12 is provided with a recess 12A which is recessed laterally inward in a part thereof adjacent to the opening 78.

Since the output end of the steering reduction gear mechanism 37 is turned, a relatively small turning angle of the tool is required for achieving a desired steering angle. The hexagonal head 57 is provided on the output shaft 39 in the present embodiment, but may also be provided in any part of a path of steering power transmission from the output shaft 39 to the lower case 11.

As shown in FIG. 4, a steering angle sensor 80 is provided in a part of the upper case 10 opposing the output shaft 39 of the steering reduction gear mechanism 37. The steering angle sensor 80 may consist of a per se known rotary encoder or the like, and the output of the steering angle sensor 80 is forwarded to a display D which may be positioned in the instrument panel of the boat 1 or on the outboard motor 2 itself so that the operator may know the steering angle when the outboard motor 2 is manually steered as well as when the outboard motor 2 is steered during normal operation.

The present invention has been described in terms of a preferred embodiment, but is not limited by the embodiment described above, and can be modified in various ways without departing from the scope of the present invention. For instance, the propulsion apparatus of the present invention may also consist of an inboard motor which is configured to be installed within the structure of the boat or any other watercraft and is not visible from outside, as opposed to the outboard motor 2 which is positioned outside the structure of the boat or any other watercraft and is clearly visible at all times.

In addition, the specific configurations, arrangements, quantities, materials, etc. of various parts can be changed as appropriate within the scope of the present invention. Moreover, the above embodiments may be combined with each other in part or all of the configurations. Further, not all of the components shown in the above embodiments are essential, and can be selected and substituted as appropriate.

The invention claimed is:

1. A propulsion apparatus for watercraft, comprising:

an upper case supported by a hull of the watercraft;

a propulsion motor supported by the upper case;

a lower case supported by the upper case so as to be rotatable around a steering axis, and rotatably supporting a drive shaft for transmitting power from the propulsion motor;

a propulsion device supported by the lower case so as to be rotationally driven by the drive shaft;

a steering motor received in the upper case; and a steering reduction gear mechanism received in the upper case and configured to reduce a rotational speed of an output of the steering motor and rotationally drive the lower case, wherein a first axis, which is an axis of a rotational output of the steering reduction gear mechanism, and a second axis, which is an axis of a rotational output of the steering motor, extend vertically in parallel with a third axis, which is an axis of the drive shaft, and the steering motor overlaps with the steering reduction gear mechanism with respect to a vertical direction, the propulsion apparatus further comprising a brake mechanism including a brake shaft extending vertically in parallel with the first axis, the second axis, and the third axis and a clutch which selectively engages the brake shaft with a fixed part of the upper case, wherein the brake shaft is positioned in a power transmission path between the output of the steering motor and an input of the steering reduction gear mechanism.

2. The propulsion apparatus according to claim 1, wherein the lower case is provided with a tubular upper end part which is received in the upper case and rotatably supported by the upper case.

3. The propulsion apparatus according to claim 2, wherein the steering reduction gear mechanism has an input end in a lower part thereof, and an output end in an upper part thereof.

4. The propulsion apparatus according to claim 3, wherein the steering reduction gear mechanism comprises a planetary gear mechanism.

5. The propulsion apparatus according to claim 1, wherein the brake shaft overlaps with the steering motor and the steering reduction gear mechanism with respect to the vertical direction.

6. The propulsion apparatus according to claim 5, wherein the output of the steering motor is provided by an output shaft extending downward from the steering motor, and the input of the steering reduction gear mechanism is provided with an input shaft extending downward from the steering reduction gear mechanism, the output shaft of the steering motor and the input shaft of the steering reduction gear mechanism being fixedly provided with respective spur gears which mesh with a spur gear fitted on the brake shaft.

7. The propulsion apparatus according to claim 6, wherein a lower part of the upper case is provided with an oil pan containing lubricating oil so that the lubricating oil is splashed by the spur gears.

8. The propulsion apparatus according to claim 6, wherein the spur gears provided on the output shaft of the steering motor, the input shaft of the steering reduction gear mechanism and the brake shaft have a substantially identical diameter.

9. The propulsion apparatus according to claim 5, wherein the clutch is an electromagnetic clutch that includes an electromagnet fixed to the upper case, a movable plate fitted on the brake shaft in a rotationally fast manner and positioned opposite to the electromagnet, a fixed plate provided opposite to the movable plate and fixed to the upper case, and a spring member urging the movable plate against the fixed plate, the electromagnet being configured to attract the movable plate away from the fixed plate against a biasing force of the spring member when energized.

10. The propulsion apparatus according to claim 1, wherein the upper case is provided with an elliptic profile which is elongated in a fore and aft direction, and wherein the brake mechanism and a propulsion reduction gear mechanism are positioned on a longitudinal center line that extends in the fore and aft direction with the propulsion reduction gear mechanism ahead of the brake mechanism, and the steering reduction gear mechanism and the steering motor are positioned on either side of the longitudinal center line, between the propulsion reduction gear mechanism and the brake mechanism with respect to the fore and aft direction.

11. Watercraft fitted with the propulsion apparatus according to claim 1.

* * * * *